US005750482A

United States Patent [19]

Cummings

[11] Patent Number: 5,750,482

[45] Date of Patent: May 12, 1998

[54] GLASS CLEANING COMPOSITION

[75] Inventor: Gerald Cummings, West Chester, Ohio

[73] Assignee: S. C. Johnson & Son, Inc., Racine, Wis.

[21] Appl. No.: 568,527

[22] Filed: Dec. 7, 1995

Related U.S. Application Data

[63] Continuation of Ser. No. 63,347, May 18, 1993, abandoned, which is a continuation of Ser. No. 743,060, Aug. 9, 1991, abandoned.

[51] Int. Cl.[6] ..... C11D 7/50

[52] U.S. Cl. ..... 510/182; 510/427; 510/428; 510/429; 510/477; 510/505; 510/506

[58] Field of Search ..... 252/DIG. 10, 143, 252/153, 158, 170, 171, 174.21, 174.22, 558, 550; 510/182, 505, 506, 427, 428, 429, 477

[56] References Cited

U.S. PATENT DOCUMENTS

| | | | |
|---|---|---|---|
| H468 | 5/1988 | Malik et al. | 252/542 |
| 3,463,735 | 8/1969 | Stonebraker | 252/137 |
| 3,607,764 | 9/1971 | Crotty et al. | 252/158 X |
| 3,664,961 | 5/1972 | Norris | 252/99 |
| 3,679,609 | 7/1972 | Castner | 252/527 |
| 3,819,522 | 6/1974 | Zmoda et al. | 252/174.21 X |
| 3,882,038 | 5/1975 | Clayton et al. | 252/164 |
| 3,939,090 | 2/1976 | Zmoda | 252/DIG. 10 |
| 4,181,623 | 1/1980 | Dillarstone et al. | 252/143 |
| 4,213,873 | 7/1980 | Church | 252/174.21 |
| 4,302,348 | 11/1981 | Requejo | 252/135 |
| 4,315,828 | 2/1982 | Church | 252/153 |
| 4,414,128 | 11/1983 | Goffinet | 252/111 |
| 4,540,505 | 9/1985 | Frazier | 252/106 |
| 4,606,842 | 8/1986 | Keyes et al. | 252/174.23 |
| 4,627,931 | 12/1986 | Malik | 252/153 |
| 4,690,779 | 9/1987 | Baker et al. | 252/546 |
| 4,749,509 | 6/1988 | Kacher | 252/170 X |
| 4,769,121 | 9/1988 | Siklosi | 252/153 |
| 4,769,172 | 9/1988 | Siklosi | 252/153 |
| 4,803,008 | 2/1989 | Ciolino et al. | 252/162 |
| 4,822,854 | 4/1989 | Ciolino | 252/174.19 |
| 5,108,660 | 4/1992 | Michael | 252/545 |
| 5,336,445 | 8/1994 | Michael et al. | 252/548 |
| 5,534,198 | 7/1996 | Masters et al. | 510/182 |
| 5,536,450 | 7/1996 | Masters et al. | 510/182 |
| 5,540,864 | 7/1996 | Michael | 510/181 |

FOREIGN PATENT DOCUMENTS

| | | |
|---|---|---|
| 105063 | 4/1984 | European Pat. Off. . |
| 0288856 | 11/1988 | European Pat. Off. . |
| 2384018 | 10/1978 | France . |
| 63-48398 | 3/1988 | Japan . |
| 3079700 | 4/1991 | Japan . |
| 2166153 | 4/1986 | United Kingdom . |
| 2167083 | 5/1986 | United Kingdom . |

OTHER PUBLICATIONS

Communication Dated Apr. 14, 1993, European Pat. Appln. Ser. No. 92307297.9 including European Search Report, 3 pages.

*Primary Examiner*—Margaret Medley
*Attorney, Agent, or Firm*—Laura L. Bozek

[57] ABSTRACT

A non-streaking glass cleaning composition comprising, on a weight basis, from about 0.1 to about 1% ethylene glycol monohexyl ether, from about 0.01 to about 0.5% of a surfactant selected from the group consisting of anionic surfactants, nonionic surfactants, amphoteric surfactants, zwitterionic surfactants and mixtures thereof, from about 0.1 to about 7% of an organic cosolvent comprising a mixture of (i) a low boiling point organic cosolvent having a boiling point of less than about 115° C. and (ii) a high boiling point organic cosolvent having a boiling point of from 120° to about 230° C., from 0 to about 2% of a builder, and water, said composition having a pH of from about 3.5 to about 11.5, to provide a non-streaking glass cleaning formulation.

27 Claims, No Drawings

GLASS CLEANING COMPOSITION

This application is a continuation of application Ser. No. 08/063,347 filed May 18, 1993, now abandoned, which is a continuation of application Ser. No. 07/743,060, filed Aug. 9, 1991, now abandoned.

FIELD OF INVENTION

This application relates to a glass cleaning composition that contains ethylene glycol monohexyl ether as an organic solvent. More specifically, the present invention concerns a glass cleaning composition containing the aforementioned solvent in an amount of about 0.05 to about 1.5%, together with a surfactant, especially an anionic surfactant, and water, which compositions provide superior, streakfree removal of soil from glass surfaces.

BACKGROUND OF INVENTION

Glass cleaning compositions are formulated not only to remove soils and dirt from the glass surface, but to do so in a streakfree manner. In this regard a glass surface is unique among hard surfaces because it reveals streaks and deposits in view of its transparency that are not perceptible when an opaque surface is cleaned. While these streaks may be residual soil not removed by the cleaning composition, they are often a result of the cleaning composition itself, if improperly formulated. In some instances the streaks are occasioned by the deposition of solid components contained in the composition, e.g., the surfactant, hydrotrope, etc. In other cases the solvent may haze up on the glass surface.

Many glass cleaning products are sold commercially, and typically contain a surfactant, an organic solvent or solvent system, a pH-adjusting agent such as ammonia or acetic acid, a detergent builder, for example, an alkali metal phosphate or polyacrylic acid resin, a hydrotrope, various adjuvants such as a fragrance or a dye, and water. WINDEX® and GLASS PLUS® are illustrative commercially available products.

Many patents have been obtained for glass cleaning compositions, and disclose suitable solvents and solvent systems. Thus, U.S. Pat. No. 3,463,735 to Stonebraker discloses a glass cleaning composition containing a solvent system comprising a low boiling solvent, e.g., isopropanol, and a moderately high boiling solvent, which can be a $C_1$ to $C_4$ alkylene glycol alkyl ether having a total of 3–8 carbon atoms. U.S. Pat. No. 4,302,348 to Requejo discloses a glass cleaning composition as described in Stonebraker, but further comprising a fluorocarbon surfactant. U.S. Pat. No. 4,606,842 to Keyes et al discloses a glass cleaning composition as described in Stonebraker, but containing a polyacrylic acid resin as a detergent builder in lieu of an alkali metal phosphate.

U.S. Pat. No. 3,882,038 to Clayton discloses hard surface cleaning compositions, including compositions drawn to the cleaning of glass surfaces, containing 1–10%, preferably 2 to 5%, of a relatively nontoxic alkylene glycol alkyl ether solvent. Suitable glycol ether solvents according to Clayton include those of the general formulas:

$$RO(C_2H_4O)_uH$$

and $$R'O(C_3H_6O)_vH$$

wherein R is a $C_{5-8}$ alkyl group, R' is a $C_{3-6}$ alkyl group, u=1–6 and v=1–4, with the provisos that R is a $C_5$ alkyl when u=1–4 and R' is a $C_{3-5}$ alkyl when v=1–3.

Clayton attributes good cleaning ability to various solvents included in the general formulas in view of cleaning tests described at columns 9 and 10. The tests were conducted on crayon-soiled white vinyl tiles, with the solvent present at a 3 and 5% level in a composition further containing a nonionic surfactant, a phosphate builder, a hydrotrope and water.

U.S. Pat. No. 3,679,609 to Castner discloses glass cleaning concentrate compositions comprising on a weight basis 30–40 parts of a lower alcohol, 14–18 parts of a first organic solvent selected from hexyl glycol, diethylene glycol, ethylene glycol and glycerol, less than 15 parts of a second organic solvent which is ethylene glycol monoethyl ether, 3–6 parts 29° ammonia, 2–4 parts higher alcohols and ethers, e.g., diethylene glycol monoethyl ether, 1.5–2.5 parts detergent, 0.5–2.5 parts selected builders, 0.25–0.75 parts EDTA, 0.1–0.5 parts sodium or potassium hydroxide, and water as the remainder.

U.S. Pat. No. 4,540,505 to Frazier discloses a disinfectant spray cleaner containing a quaternary ammonium compound in a germicidally effective amount, 0.4–1% d-limonene, 4–6% of a monoether of an aliphatic glycol which contains from 59–65% carbon, 1–1.5% nonionic surfactant, about 1% alkali builder and water. The monoether is included to stabilize the d-limonene, and to enhance soil and stain removability. Example 3 illustrates a composition containing ethylene glycol monohexyl ether at a 6% level. Utility as a glass cleaner is not disclosed.

U.S. Pat. No. 4,749,509 to Kacher discloses a cleaning composition containing 0.5–15% diethylene glycol monohexyl ether, 0.5–70% detergent builder, 0–15% organic surfactant and water.

U.S. Pat. No. 4,769,121 to Siklosi discloses built detergent compositions containing polyalkyleneglycoliminodiacetic acid, the composition further containing a degreasing solvent which can be a glycol ether of the formula $R^1O—(R^2O)_m—H$ wherein $R^1$ is an alkyl of from 4 to 8 carbon atoms, $R^2$ is either ethylene or propylene, and m is 1 to 3.

Malik, U.S. Pat. No. 4,627,931, discloses hard surface cleaner compositions containing an alkyl glycoside surfactant and an organic solvent which can be an alkylene glycol and/or an alkylene glycol ether in an amount of from about 10 to about 50% in the form of a concentrate, or from about 0.1 to about 10% in diluted form. U.S. Stat. Inv. Reg. H468, also to Malik, further discloses incorporation of alkyl glycosides in alkaline hard surface cleaner compositions.

The commercially available glass cleaning products sold under the WINDEX and GLASS PLUS trademarks have as their organic solvent system a mixture of ethylene glycol monobutyl ether and isopropyl alcohol.

The product CINCH sold by Procter & Gamble Company has been recently introduced and contains 3% propylene glycol monobutyl ether and 7% isopropanol as the solvent system, surfactant, water and other components.

Notwithstanding the availability of commercial glass cleaning products, an improved glass cleaning composition which exhibits superior cleaning performance in the removal of soils, and which does so in a substantially nonstreaking manner is desirable. Collaterally, a glass cleaning product that has at least parity performance with the known products, but which requires substantially less organic solvent in the composition, is also desirable. This is not only a benefit in terms of cost of manufacture, but is highly advantageous from an environmental standpoint, as less solvent will be produced and released to the environment.

It has been found, surprisingly, that the organic solvent ethylene glycol monohexyl ether, when present in low concentrations in a ready-to-use glass cleaning product, provides not only excellent soil removal from the glass surface, but also dries from the glass surface without hazing, and without causing streaking.

SUMMARY OF THE INVENTION

It is an object of the present invention to provide a glass cleaning composition that effectively removes soils from the surface glass.

It is a further object of the present invention to clean the glass surface to provide a hazefree or streakfree finish.

A primary objective of the present invention is to reduce the level of the higher boiling organic solvent present in a glass cleaning product.

Yet another object of the present invention is to provide a composition that has good lubricity, that is, a composition which is distributed easily over the glass surface using a paper or fabric towel, and which does not require extensive buffing with such towel to avoid streaking.

These and other benefits and advantages will be more completely understood upon a reading of the detailed description of the invention, a summary of which follows.

The glass cleaning composition of the present invention comprises on a weight basis from about 0.05 to about 1.5% of an organic solvent which is ethylene glycol monohexyl ether, from about 0.01 to about 2% of a surfactant, and water. Preferably, the composition further contains additional components to improve the performance and elegance of the product. Thus, the compositions herein disclosed may contain pH modifying agents in an amount effective to achieve a desired pH, detergent builders, hydrotropes, chelating or sequestering agents, dyes, perfumes and stabilizers.

The compositions of the instant invention may also contain organic cosolvents, for example, lower boiling alcohols and moderately high boiling glycols and glycol ethers, especially water-soluble organic cosolvents. It is also advantageous in many instances to include a low level of a fluorosurfactant to reduce the surface tension of the product composition, in order to improve lubricity and wetting of the glass surface.

DETAILED DESCRIPTION OF THE INVENTION

The glass cleaner composition of the present invention comprises ethylene glycol monohexyl ether as a high boiling organic solvent, a surfactant or surfactant mixture and water. Preferably, the composition includes a pH modifying agent, especially an alkalinity agent, a fluorocarbon surfactant, and an organic cosolvent. The ethylene glycol monohexyl ether component can be regarded as the primary solvent herein.

It has been found, as will be further considered in the examples below, that a low level of ethylene glycol monohexyl ether incorporated in a glass cleaning composition enhances the performance of the composition greatly in terms of its soil removal capacity. Further, the performance is excellently suitable for cleaning glass surfaces as the composition is substantially streakfree and hazefree subsequent to application and wiping with a paper or fabric towel. Moreover, the compositions are easy to use by the consumer, as excessive buffing of the composition applied to the glass surface with the paper or fabric towel is not required. That is, the consumer is required to buff the glass surface only moderately or gently with the paper or fabric towel in order to achieve a clean, streakfree and hazefree glass surface.

The ethylene glycol monohexyl ether solvent is incorporated in the composition in an amount of from about 0.05 to about 1.5% by weight of the composition. Preferably, this solvent is present in an amount of from about 0.1 to about 1.0%, most preferably in an amount of less than 1%, but greater than about 0.25%.

Inasmuch as the glass cleaning utility is a particularly severe test of product composition performance, the compositions of the present invention are also suitable for cleaning other hard surfaces, such as metallic, e.g., aluminum and chrome, countertops such as made from Formica®, walls, porcelain, ceramic tiles, plastic, e.g., vinyl, enameled and like surfaces.

Cosolvents

The composition may also contain one or more polar organic cosolvents, especially a mixture of a polar low and a polar high boiling organic solvent. The level of the cosolvent is from about 0 to about 15% by weight of the composition, although preferably the amount of cosolvent is about 10% by weight or less, most preferably from about 0.1 to about 7%.

As the low boiling cosolvent mention may be made of $C_1$ to $C_4$ alcohols, which have a boiling point of less than about 1150° C. The low boiling solvent is present in an amount of from 0 to about 10%, preferably in an amount of 0.1 to 8%, most preferably in an amount of 1 to 5% by weight of the composition. Suitable low boiling cosolvents are methyl alcohol, ethyl alcohol, isopropyl alcohol, n-butyl alcohol and sec-butyl alcohol. Isopropyl alcohol is preferred.

The high boiling organic cosolvent is an alkylene glycol or polyalkylene glycol of from 2 to 6 carbon atoms, an ethylene or propylene glycol mono-$C_{1-4}$-alkyl ether, and $C_{2-3}$dialkylene glycol mono-$C_{1-4}$-alkyl ethers, said high boiling organic cosolvent typically having a boiling point of from 120 to about 230° C., preferably from about 150° to 200° C. Further, the high boiling organic cosolvent should preferably be completely soluble in water at 20° C., and even further preferably should have an evaporation rate relative to n-butyl acetate (100) of from about 5 to about 25.

Illustrative of the alkylene glycol cosolvent is ethylene glycol, propylene glycol, tri- and tetramethylene glycol, 1,2- and 1,3-butanediol, 1,2- and 1,4-pentanediol and 2,3-hexanediol.

Illustrative of the glycol ether cosolvent is ethylene glycol monoethyl ether, ethylene glycol monopropyl ether, ethylene glycol monobutyl ether, diethylene glycolmonoethyl ether, diethylene glycol monobutyl ether, propylene glycol monopropyl ether, propylene glycol monobutyl ether and dipropylene glycol monomethyl ether. Ethylene glycol monobutyl ether is preferred.

The high boiling cosolvent is typically present in an amount of from 0 to 10%, preferably in an amount of 0.1 to about 5%, most preferably in an amount of from about 1 to about 3%, by weight of the composition. Generally, compositions containing the high boiling cosolvent will also contain the low boiling cosolvent, to provide a cosolvent mixture or system.

Generally, the total solvent level present in the composition, including the ethylene glycol monohexyl ether and all cosolvents, will not exceed about 15% by weight of the composition, preferably will be less than about 10% by weight of the composition, and most preferably less than about 7% by weight of the composition.

Further, compositions containing ethylene glycol monohexyl ether in an amount proximate the upper end of the concentration range for this constituent advantageously will preferably include at least the low boiling alcohol as the cosolvent, within the aforementioned concentration range limitations. High boiling cosolvents that are not completely water-soluble are generally not incorporated when the amount of ethylene glycol monohexyl ether is proximate the upper end of the concentration range.

The Surfactant Component

Anionic, nonionic, amphoteric, and zwitterionic surfactants are suitable in the composition of the present invention, and are present in an effective cleaning amount, typically from about 0.001 to about 2%, preferably in an amount of from about 0.01 to about 0.5%, most preferably from about 0.05 to about 0.3% by weight of the composition. Anionic and nonionic surfactants are especially preferred. Amphoteric surfactants are generally suitable in an alkaline composition.

The anionic surfactants are suitably water-soluble alkyl or alkylaryl compounds, the alkyl having from about 8 to about 22 carbons, including a sulfate or sulfonate substituent group that has been base-neutralized, typically to provide an alkali metal, e.g., sodium or potassium or an ammonium cation, including, for example: (1) alkyl and alkylaryl sulfates and sulfonates having preferably 8 to 18 in the carbons in the alkyl group, which may be straight or branched chain, e.g., sodium lauryl sulfate and sodium dodecylbenzene sulfonate; (2) alphaolefin aryl sulfonates preferably having from about 10 to 18 carbons in the olefin, e.g., sodium $C_{14-16}$ olefin sulfonate, which is a mixture of (3) sulfated and sulfonated monoglycerides, especially those derived form coconut oil fatty acids; (4) sulfate esters of ethoxylated fatty alcohols having 1–10 mols ethylene oxide, e.g., sodium polyoxyethylene (7 mol EO)lauryl ether sulfate, and of ethoxylated alkyl phenols having 10 mols ethylene oxide and 8 to 12 carbons in the alkyl, e.g., ammonium polyoxyethylene(4 mol EO)nonyl phenyl ether sulfate; (5) base-neutralized esters of fatty acids and isethionic acid, e.g., sodium lauroyl isethionate; (6) fatty acid amides of a methyl tauride, e.g., sodium methyl cocoyl taurate; (7) β-acetoxy- or β-acetamido-alkane sulfonates, and (8) sarcosinates having from 8 to 22 carbons, e.g., sodium lauroyl sarcosinate.

The nonionics include (1) fatty alcohol alkoxylates, especially the ethoxylates, wherein the alkyl group has from 8 to 22, preferably 12 to 18, carbons, and typically 6 to 15 mol alkoxide per molecule, e.g., coconut alcohol condensed with about nine mols ethylene oxide; (2) fatty acid alkoxylate having from about 6 to about 15 mols alkoxylate, especially the ethoxylate; (3) alkylphenoxy alkoxylates, especially the ethoxylates, containing 6 to 12 carbons, preferably octyl or nonyl, in the alkyl, and having about 5 to 25, preferably 5 to 15 mols alkylene oxide per molecule, e.g., nonyl phenol ethoxylated with about 9.5 mols ethylene oxide (Igepal CO-630); (4) condensates of ethylene oxide with a hydrophobic base formed by condensation of propylene oxide with propylene glycol, e.g., nonionic surfactants of the Pluronic series manufactured by BAFS Wyandotte, (5) condensates of ethylene oxide with an amine or amide; (6) fatty amine oxides, e.g., stearyl dimethyl amine oxide, and (7) alkylolamides.

Preferred anionics are the alkyl and alkylaryl sulfates and the alpha-olefin aryl sulfonates, while preferred nonionics are the fatty alcohol ethoxylates. Sodium lauryl sulfate and sodium dodecyl benzene sulfonate are especially preferred.

The Fluorosurfactant Component

It has also been discovered in accordance with the present invention that the effectiveness of the aqueous glass cleaning compositions of this invention can be further enhanced by incorporating a small amount of an organofluorocarbon surfactant in active amounts within the range of from about 0.001–0.5% by weight, preferably from about 0.01–0.1% by weight, based on the total composition. The preferred fluorocarbon surfactants include the anionic salts of perfluoroaliphaticoxybenzene sulfonic acids and the anionic salts of linear perfluoroalkyl-oxybenzoic acids. Examples of the former class of fluorocarbon surfactants can be represented by the following formula:

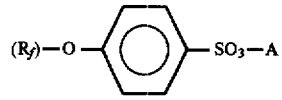

where $R_f$ is a perfluoroaliphatic group of from about 5 to about 15 carbon atoms, preferably from about 8 to 12 carbon atoms in the aliphatic group which may be an alkyl group or alkenyl group, and A is a cation such as an alkali metal, ammonium or amine.

Examples of the latter class of fluorocarbon surfactants can be represented by the formula:

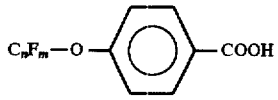

wherein n is a number of from about 2 to about 16 and m is a number from about 3 to about 34.

Other suitable fluorocarbon surfactants are:

(a) $R_fCH_2CH_2SCH_2CO_2M$ wherein $R_f$ is $F(CF_2CF_2)_n$ and n is from about 3 to about 8 and M is alkali metal (e.g., sodium or potassium) or ammonium;

(b) $C_nF_{2n+1}CO_2M$ wherein $C_nF_{2n+1}$ is a straight chain fluorocarbon radical, n is from about 8 to about 12 and M is alkali metal or ammonium;

(c) $C_nF_{2n+1}SO_3M$ wherein $C_nF_{2n+1}$ is a straight chain fluorocarbon radical, n is from about 8 to about 12 and M is an alkali metal cation;

(d) $R_fCH_2CH_2O(CH_2CH_2O)_nH$ wherein $R_f$ is a straight chain $F(CF_2CF_2)_n$ radical and n is from about 3 to about 8;

(e) $R_f(OCH_2CH_2)_nOR_f$ wherein $R_f$ is a branched chain radical of the formula $C_8F_{15}$, $C_{10}F_{19}$ or $C_{12}F_{23}$ and n is from about 10 to about 30, and (f) $R_f(OCH_2CH_2)_mOR$ wherein $R_f$ is a branched chain radical of the formula $C_8F_{15}$, $C_{10}F_{19}$ or $C_{12}F_{23}$, m is from about 2 to about 20 and R is $C_1$ to $C_3$ alkyl.

Fluorinated hydrocarbon surfactants are available from numerous commercial sources as trademarked products. Examples are ZONYL fluorosurfactants from E.I. duPont de Nemours & Co., FLUORAD fluorosurfactants from 3M Company, e.g., FLUORAD FC-129 ($R_fSO_2N(C_2H_5)CH_2CO_2^-K^+$, where $R_f$ is $C_nF_{2n+1}$ and n is about 8), and MONOFLOR fluorocarbon surfactants from I.C.I. Americas, Inc.

As used herein, the term "fluorocarbon surfactant" is intended to designate a class of surfactants distinct and separate from the anionic, etc., surfactants referred to in the preceding section.

pH Modifying Agents

The compositions of the present invention may have a pH which is either alkaline or acidic. A neutral pH is not preferred, but is within the scope of the invention. Typically, the pH of the composition is between about 3.5 to about 6.5 when an acidic composition is desired, and between about 7.5 to about 11.5 when an alkaline composition is desired.

Sufficient pH modifying agent is incorporated to obtain the desired pH, and should be compatible with the streakfree cleaning intent of the present invention. Generally, the amount of pH modifying agent is between about 0.01 to about 2%.

Preferably a relatively weak organic acid is employed to provide an acid pH. Suitable organic acids are acetic acid, citric acid, propionic acid, sulfamic acid, succinic acid and maleic acid. Acetic acid is preferred. Dilute mineral acids may also be used, e.g., hydrochloric, phosphoric and sulfuric acids.

Preferably, aqueous ammonium hydroxide (29.4% active ammonia) is employed to provide an alkaline pH, the aforementioned typical concentration range being for this concentration solution. Also suitable are other bases, in particular, organic alkanolamines, for example, mono-, di- and triethanolamine. Morpholine is also suitable. Dilute strong bases may also be used, e.g., sodium hydroxide, sodium carbonate and the like.

Optional Constituents

Various optional constituents may be incorporated in the compositions of the present invention to enhance performance or elegance of the products.

Builders are constituents which enhance the detergent power of the surfactant. Suitable builders are alkali metal phosphates. However, phosphates are not preferred in view of environmental constraints. Polyacrylic acid resins may also be incorporated, as taught in U.S. Pat. No. 4,606,842 to Keyes et al, incorporated herein by reference thereto. Another suitable builder is sodium carboxymethyloxysuccinate. The art also recognizes that ammonium hydroxide, described above as an alkalinity agent, has efficacy as a builder. As used herein, however, the term "builder" does not include ammonium hydroxide. The builder component, when present, is generally present in an amount of from about 0.01 to about 2% by weight of the composition, preferably from about 0.1 to about 1%. The amount of builder will, of course, depend on the choice of agent used, as is known in the art.

Chelating or sequestering agents, when used, are in an amount of from about 0.01 to about 1%. Suitable such agents are ethylene diamine tetraacetic acid, sodium nitrilotriacetate and sodium citrate.

The compositions of the present invention have a cloud point of above about 125° F., preferably above about 150° F., most preferably above about 190° F. A hydrotrope component, if required, may be incorporated in an amount to obtain this parameter. Preferred hydrotropes are alkali metal salts of aromatic sulfonates, e.g., sodium xylene sulfonate, sodium toluene sulfonate, etc. Another class of hydrotropes is certain dicarboxylic acids sold under the trade name DIACID by Westvaco Chemical Division, as described in U.S. Pat. No. 4,983,317 to Requejo et al, incorporated herein by reference. The hydrotrope is generally present in an amount of less than 5%, preferably less than 1%, by weight of the composition. It has been found, however, that the compositions of the present invention often do not require a hydrotrope.

Buffers are also useful optional constituents of the present invention, to maintain pH within a desired range. Such buffers are present in an amount to maintain the pH within such range, typically from about 0 to about 1% by weight of the composition.

Other adjuvants include dyes at a level of from about 0.001 to about 1% and perfumes at a level of from about 0.001 to about 1%, the amount being such as to achieve a desired hue or scent, but without compromising the suitability of the product.

The products of the present invention may be provided in aerosol form, by pressurizing the composition in an aerosol can having an effective pressurizing amount of propellant. Typically, such products would further include a small amount of a corrosion inhibitor.

Process of Manufacture

Generally, it is desirable to prepare the compositions of the present invention by first admixing the surfactant component, water and at least a portion of the cosolvents, if any, before incorporating the ethylene glycol monohexyl ether primary solvent. Preferably, the ingredients are admixed with stirring to hasten dissolution. Mixing is done at ambient temperature, although somewhat elevated temperatures may be useful. Applicant has found that the compositions of the present invention do not cloud up at 20° C., and exhibit excellent thermal stability, as indicated in Example 7.

The advantages and benefits of the present invention are further illustrated in the following Examples, wherein all ingredient concentrations are on an active basis by weight, unless otherwise indicated.

EXAMPLE 1

Compositions A (within the scope of the present invention) and B (outside the scope of the present invention) described below were prepared:

| | Concentration (Wt. %) | |
|---|---|---|
| Ingredient | Comp. A | Comp. B |
| Ethylene glycol monohexyl ether | 1.0 | — |
| Ethylene glycol monobutyl ether | — | 9.0 |
| Sodium dodecyl benzene sulfonate | 0.1176 | 0.1176 |
| Acetic acid | 0.1667 | 0.1667 |
| Fluorad FC 171[1] | 0.01 | 0.01 |
| Sodium oxalate | 0.0025 | 0.0025 |
| Water | << Q.S. 100% >> | |
| pH | | |

[1]50% active anionic

Compositions A and B were then comparatively tested for performance in cleaning glass, as described below. This procedure was also used in the other Examples, with any departures from this procedure being noted therein.

In these cleaning performance tests, four 6.5×7.75-inch rectangular glass panes were used. Each glass pane was evenly soiled with 8.3 g of a soil comprising 2% beef fat and 98% perchloroethane, and then divided into half-sections. After the perchloroethane evaporated, one soiled half-pane section of each pane was sprayed with 2.0±0.2 g of Composition A and the other soiled half-pane section was sprayed with 2.0±0.2 g of the "control" composition, here Composition B. After 30 seconds the soiled sections of each plate were wiped with cheesecloth at a constant applied pressure of 1.0 pound for 10 cycles in a Gardner Washability Machine. In these tests left-right bias was avoided by alternating the half-section cleaned with the test compositions.

For each glass pane, each half-section cleaned with Composition A was blindly rated comparatively against the half-section cleaned with Composition B by a panel of 16 judges who have considerable experience in making such judgments, for a total of 64 determinations. The judges graded each half-section as follows: In a forced choice evaluation of cleaning, the judges blindly picked the "cleaner" side and rated this side on a scale of 1 to 4. In making their decision, the judges considered three product performance attributes—"cleaner side," "cleaner shine" and "fewer streaks." The rating scale was described to the judges as follows:

1 I think this side is better

2 I know this side is better

3 This side is a lot better

4 This side is a whole lot better

These results were statistically evaluated by the test sponsor. A "win" for the composition of the present invention (Composition A) was assigned a positive value equal to a judge's rating. A "loss" for Composition A was assigned a negative value equal to a judge's rating. The number of wins and losses for Composition A was determined, and an average cleaning score for Composition A determined by summing all positive and negative values for Composition A and dividing this sum by the number of wins. The higher the average cleaning score, the more pronounced the difference in cleaning between the Composition A and the control (Composition B in this instance). A negative average cleaning score indicates that the control was adjudged the better cleaner.

The results of this test showed that Composition A provided superior cleaning versus the Composition B control at a 95% confidence level (45 wins; 19 losses). The average cleaning score was 0.73.

In this experiment it is noteworthy that the solvent concentration in Composition A was only 1%, while that in Composition B was 9%. The glass panes cleaned with Composition A were streak- and hazefree.

EXAMPLE 2

Composition C (outside this invention) was prepared, which was otherwise identical to Composition A, but contained 1% diethylene glycol monohexyl ether in lieu of the 1% ethylene glycol monohexyl ether.

When used to clean a glass panel, Composition C left a haze that was very difficult to remove by rubbing with a paper towel.

EXAMPLE 3

Composition D was prepared, as provided below:

| Ingredient | Composition D (Wt. %) |
|---|---|
| Ethylene glycol monohexyl ether | 0.5 |
| Sodium deodecyl benzene sulfonate | 0.235 |
| Acetic acid | 0.1667 |
| Fluorad FC 171 | 0.02 |
| Sodium oxalate | 0.0025 |
| Deionized water | << Q.S. 100% >> |
| pH | |

Composition D (this invention) was tested against Composition B of Example 1, using the same procedure as described in Example 1, but on a polished chrome surface. Based on the 64 ratings of the 16 judges, Compositions B and D were found to perform at parity, notwithstanding a solvent level in Composition B that was 18 times greater than that present in Composition D. The average cleaning score for Composition D was zero.

Composition D had a cloud point of >190° F.

EXAMPLE 4

Composition E (this invention) was prepared, which was otherwise identical to Composition D, except that it contained 0.75% ethylene glycol monohexyl ether in lieu of 0.5% of that organic solvent.

Composition E was tested against Composition B of Example 1, in accordance with the test procedure of Example 1, except a polished chrome surface was employed. Composition E recorded 59 wins versus 5 losses; the average cleaning score was 1.75.

EXAMPLE 5

Composition F (this invention) was prepared, which contained the following:

| Ingredient | Composition F (Wt. %) |
|---|---|
| Ethylene glycol monohexyl ether | 1.0 |
| Sodium dodecyl benzene sulfonate | 0.2352 |
| Acetic acid | 0.1667 |
| Fluorad FC 171 | 0.02 |
| Perfume | 0.01 |
| Dye | 0.0042 |
| Deionized water | << Q.S. 100% >> |

Cleaning tests were conducted using Compositions F and B of the type described in Example 1, but on a polished chrome surface and with 18 judges. No incompatibility with the dye and perfume was observed for Composition F. Cleaning of the chrome plate with Composition F was superior to that with Composition B (62 wins, 10 losses). The average cleaning score was 1.54.

EXAMPLE 6

The effect on isopropyl alcohol (IPA) level in Composition A was evaluated. Composition G was the same as Composition A, but also contained 2% IPA and 0.02% Fluorad FC 171. A soil load of 15.5 g was also used and the plates were aged overnight.

In tests on chrome plates, Composition G was preferred over composition B (48 wins; 32 losses; 0.38 average cleaning value, based on ratings of 20 judges).

EXAMPLE 7

Composition A was tested for thermal stability, and was found to be stable for at least 28 days at 40° F., 28 days at 125° F. and 180 days at 100° F. Composition A was also stable throughout three 24-hour freeze-thaw cycles.

EXAMPLE 8

The Compositions H to P were prepared, having the following compositions:

| Ingredient | Concentration (Wt. %) |
|---|---|
| Ethylene glycol monohexyl ether | per Table below |
| Isopropyl alcohol | per Table below |
| Sodium dodecyl benzene sulfonate | 0.2352 |
| Acetic acid | 0.1667 |
| Fluorad FC-171 | 0.02 |
| Sodium oxalate | 0.0025 |
| Dye | 0.0045 |
| Perfume | 0.01 |
| Water | << Q.S. 100% >> |

| Composition | Solvent(s) (Wt. %) | |
|---|---|---|
| | EGHE | IPA |
| H | 1.2 | — |
| I | 1.25 | — |
| J | 1.25 | 3.0 |
| K | 1.5 | — |
| L | 1.5 | 3.0 |
| M | 2.0 | — |
| N | 2.0 | 3.0 |
| O | 3.0 | — |
| P | 3.0 | 3.0 |

The Compositions H through P were tested visually for suitability as to "wipe out and "hazing." In the wipe out test, the test composition was sprayed uniformly on a clean mirror and wiped with a cheesecloth until dry. In the hazing test, the test composition was sprayed uniformly on a clean mirror and lightly wiped with a cheesecloth, residual composition remaining on the mirror after wiping to determine whether hazing occurred on composition evaporation. These tests were conducted carefully to ensure that each mirror was essentially identically tested. The Compositions H through P were also observed with regard to composition phase stability. The results are provided below.

| Composition | Phase Stability | Wipe Out | Hazing |
|---|---|---|---|
| H | Very slightly turbid | Clean | Slightly hazed, some streaks |
| I | Slightly turbid | Clean | Slightly streaked, no hazing |
| J | Clear | Clean | Minor streaking, very slightly hazed |
| K | Turbid | Clean | Slight streaking, no haze |
| L | Slightly hazy | Clean | Slight streaking, no haze |
| M | Opaque | Some streaks | White haze |
| N | Opaque | Some streaks | White haze |
| O | Opaque | Many streaks | Heavy white haze |
| P | Opaque | Many streaks | Heavy white haze |

Additional Compositions M, N, O and P underwent phase separation after preparation. Compositions K and L underwent slight phase separation after preparation.

These tests indicate that an amount of ethylene glycol monohexyl ether above 1% is less acceptable for cleaning glass. Levels between 1% and 1.5% may be regarded as marginal, while levels above 1.5% are not useful in the compositions of the present invention, even with incorporation of 3% isopropyl alcohol cosolvent.

EXAMPLE 9

Composition Q was prepared:

| Ingredients | Concentration (Wt. %) |
|---|---|
| | Q |
| Ethylene glycol monohexylether | 1.0 |
| Sodium dodecyl benzene sulfonate | 0.1176 |
| Fluorad FC 129 | 0.05 |
| Ammonia (29.4% active) | 1.0 |
| Potassium iodide | 0.003 |
| Water | << Q.S. 100% >> |

The Composition Q was tested as in Example 1 (but with 20 judges) against the Procter and Gamble product CINCH, which contains 3% propylene glycol monobutyl, ether and 7% isopropyl alcohol. CINCH also contained an alkalizing agent which is monoethanolamine and a surfactant.

The test results indicated that Composition Q was superior to CINCH, notwithstanding the very high solvent contained in that commercial product (66 wins, 14 losses, 1.03 average cleaning score).

EXAMPLE 10

The compositions in the table which follows are illustrative of the present invention.

| Ingredient | CONCENTRATION (Wt. %) | | | | | | | | |
|---|---|---|---|---|---|---|---|---|---|
| | R | S | T | U | V | W | X | Y | Z |
| Ethylene glycol monohexyl ether | 0.5 | 0.25 | 1.0 | 1.0 | 1.2 | 1.0 | 0.75 | 0.75 | 1.0 |
| Ethylene glycol monobutyl ether | — | 2.0 | — | 3.0 | — | 3.0 | 1.0 | — | — |
| Isopropyl alcohol | — | 2.0 | 3.0 | 7.0 | — | 7.0 | 3.0 | 3.0 | — |

-continued

| Ingredient | CONCENTRATION (Wt. %) | | | | | | | | |
|---|---|---|---|---|---|---|---|---|---|
| | R | S | T | U | V | W | X | Y | Z |
| Sodium lauryl sulfate | — | — | 0.1 | — | | — | — | 0.15 | — |
| Sodium dodecyl benzene sulfonate | 0.1 | 0.1 | — | 0.08 | 0.2 | 0.15 | 0.25 | — | 0.2 |
| Nonoxynol-5 | — | 0.05 | — | 0.05 | — | — | — | 0.10 | 0.1 |
| Polyacrylic acid (MW = 3000) | — | 0.02 | | — | | — | 0.02 | — | 0.05 |
| Fluorosurfactant | — | 0.01 | — | 0.01 | — | 0.01 | — | 0.02 | — |
| Acetic acid | — | — | 0.15 | — | 0.1 | 0.1 | — | 0.15 | — |
| Ammonia (29.4% active) | — | 1.0 | — | 1.0 | — | — | 0.5 | — | 1.0 |
| Potassium iodide | — | 0.01 | — | 0.03 | — | — | 0.01 | — | 0.01 |
| Sodium oxalate | — | — | 0.01 | — | 0.01 | 0.01 | — | 0.01 | — |
| Dye | — | 0.01 | 0.01 | 0.01 | — | 0.01 | 0.02 | 0.05 | 0.05 |
| Perfume | — | 0.01 | 0.01 | 0.06 | — | 0.02 | 0.02 | 0.05 | 0.05 |
| Water | | | | | Q.S. 100% | | | | |

What is claimed is:

1. A non-streaking glass cleaning composition formulated for direct application to glass surfaces, in use, the composition consisting essentially of, by percent weight of the entire composition:

from about 0.01 to about 0.5%, in total, of at least one surfactant selected from the group consisting of sodium dodecyl benzene sulfonate, sodium lauryl sulfate, and nonoxynol -5;

from about 0.001 to about 0.1% of a fluorosurfactant selected from the group consisting of (a) anionic salts of perfluoroaliphaticoxybenzenesulfonic acids, (b) anionic salts of linear perfluoroalkyloxybenzoic acids, (c) fluorosurfactants having the formula $R_fCH_2CH_2SCH_2CO_2M$, where $R_f$ is $F(CF_2CF_2)_n$, and n is about 3 to about 8 and M is one of an alkali metal and ammonium, (d) fluorosurfactants having the formula $C_nF_{2n+1}CO_2M$, where $C_nF_{2n+1}$ is a straight chain fluorocarbon radical, n is from about 8 to about 12, and M is one of an alkali metal and ammonium, (e) fluorosurfactants having the formula $C_nF_{2n+1}SO_3M$, where $C_nF_{2n+1}$ is a straight chain fluorocarbon radical, n is from about 8 to about 12, and M is an alkali metal cation, (f) fluorosurfactants having the formula $R_fCH_2CH_2O(CH_2CH_2O)_nH$, where $R_f$ is a straight chain $F(CF_2CF_2)_n$ radical and n is from about 3 to about 8, (g) fluorosurfactants having the formula $R_f(OCH_2CH_2)_nOR_f$, where $R_f$ is a branched chain radical selected from the group consisting of $C_8F_{15}$, $C_{10}F_{19}$, and $C_{12}F_{23}$, and n is from about 10 to about 30, (h) fluorosurfactants having the formula $R_f(OCH_2CH_2)_mOR$, where $R_f$ is a branched chain radical selected from the group consisting of $C_8F_{15}$, $C_{10}F_{19}$, and $C_{12}F_{23}$, m is from about 2 to about 20, and R is a $C_1$ to $C_3$ alkyl, (i) FLUORAD FC-129, $R_fSO_2N(C_2H_5)CH_2CO_2^-K^+$, where $R_f$ is $C_nF_{2n+1}$ and n is about 8, and (j) FLUORAD FC-171, $R_fSO_2N(C_2H_5)(CH_2CH_2O)_xCH_3$, where $R_f$ is $C_nF_{2n+1}$, n is about 8, and the average value of x is about 7;

from about 0.1 to about 1% ethylene glycol monohexyl ether;

from about 1 to about 5% of a low boiling solvent having a boiling point of less than about 115° C. selected from the group consisting of methyl alcohol, ethyl alcohol, isopropyl alcohol, n-butyl alcohol, and sec-butyl alcohol;

from about 1 to about 3% of a high boiling solvent having a boiling point of from 120° to about 230° C. selected from the group consisting of ethylene glycol, propylene glycol, trimethylene glycol, tetramethylene glycol, 1,2-butanediol, 1,2-pentanediol, 1,4-pentanediol, 2,3-hexanediol, ethylene glycol monoethyl ether, ethylene glycol monopropyl ether, ethylene glycol monobutyl ether, diethylene glycol monoethyl ether, diethylene glycol monobutyl ether, propylene glycol monopropyl ether, propylene glycol monobutyl ether, and dipropylene glycol monomethyl ether; and water; and a pH modifying agent selected from (i) an acidic pH modifying agent to provide a pH of from about 3.5 to about 6.5 and (ii) a basic pH modifying agent to provide a pH from about 7.5 to about 11.5.

2. A composition according to claim 1, wherein the fluorosurfactant is selected from the group consisting of FLUORAD FC-129, $R_fSO_2N(C_3H_5)CH_2CO_2^-K^+$, where $R_f$ is $C_nF_{2n+1}$ and n is about 8) , and FLUORAD FC-171, $R_fSO_2N(C_2H_5)(CH_2CH_2O)_xCH_3$, where $R_f$ is $C_nF_{2n+1}$, n is about 8, and the average value of x is about 7.

3. A composition according to claim 2, wherein the fluorosurfactant is FLUORAD FC-171, $R_fSO_2N(C_2H_5)(CH_2CH_2O)_xCH_3$, where $R_f$ is $C_nF_{2n+1}$, n is about 8, and the average value of x is about 7.

4. A composition according to claim 1, wherein the low boiling solvent is isopropyl alcohol and the high boiling solvent is ethylene glycol monobutyl ether.

5. A composition according to claim 1, wherein the pH modifying agent is present in an amount of about 0.01 to about 2% and is selected from the group consisting of acetic acid, citric acid, propionic acid, sulfamic acid, succinic, acid, maleic acid, hydrochloric acid, phosphoric acid, sulfuric acid, aqueous ammonium hydroxide, monoethanolamine, diethanolamine, triethanolamine, morpholine, sodium hydroxide, and sodium carbonate.

6. A composition according to claim 1, wherein the composition also has therein from 0 to about 2% of a builder selected from the group consisting of alkali metal phosphates, polyacrylic acid resins, and sodium carboxymethyloxysuccinate.

7. A composition according to claim 1, wherein the composition has a cloud point of above about 125° F.

8. A composition according to claim 1, wherein the composition has a cloud point of above about 150° F.

9. A composition according to claim 1, wherein the composition has a cloud point of above about 190° F.

10. A non-streaking glass cleaning composition formulated for direct application to glass surfaces, in use, the composition consisting essentially of, by percent weight of the entire composition:

from about 0.01 to about 0.5%, in total, of at least one surfactant selected from the group consisting of anionic surfactants, nonionic surfactants, amphoteric surfactants, zwitterionic surfactants, and mixtures thereof;

from about 0.001 to about 0.1% of a fluorosurfactant selected from the group consisting of (a) anionic salts of perfluoroaliphaticoxybenzenesulfonic acids, (b) anionic salts of linear perfluoroalkyloxybenzoic acids, (c) fluorosurfactants having the formula $R_fCH_2CH_2SCH_2CO_2M$, where $R_f$ is $F(CF_2CF_2)_n$, and n is about 3 to about 8 and M is one of an alkali metal and ammonium, (d) fluorosurfactants having the formula $C_nF_{2n+1}CO_2M$, where $C_nF_{2n+1}$ is a straight chain fluorocarbon radical, n is from about 8 to about 12, and M is one of an alkali metal and ammonium, (e) fluorosurfactants having the formula $C_nF_{2n+1}SO_3M$, where $C_nF_{2n+1}$ is a straight chain fluorocarbon radical, n is from about 8 to about 12, and M is an alkali metal cation, (f) fluorosurfactants having the formula $R_fCH_2CH_2O(CH_2CH_2O)_nH$, where $R_f$ is a straight chain $F(CF_2CF_2)_n$ radical and n is from about 3 to about 8, (g) fluorosurfactants having the formula $R_f(OCH_2CH_2)_nOR_f$, where $R_f$ is a branched chain radical selected from the group consisting of $C_8F_{15}$, $C_{10}F_{19}$, and $C_{12}F_{23}$, and n is from about 10 to about 30, (h) fluorosuarfactants having the formula $R_f(OCH_2CH_2)_mOR$, where $R_f$ is a branched chain radical selected from the group consisting of $C_8F_{15}$, $C_{10}F_{19}$, and $C_{12}F_{23}$, m is from about 2 to about 20, and R is a $C_1$ to $C_3$ alkyl, (i) FLUORAD FC-129, $R_fSO_2N(C_2H_5)CH_2CO_2^-K^+$, where $R_f$ is $C_nF_{2n+1}$ and n is about 8, and (j) FLUORAD FC-171, $R_fSO_2N(C_2H_5)(CH_2CH_2O)_xCH_3$, where $R_f$ is $C_nF_{2n+1}$, n is about 8, and the average value of x is about 7;

from about 0.1 to about 1% ethylene glycol monohexyl ether;

from about 1 to about 5% of a low boiling solvent having a boiling point of less than about 115° C. selected from the group consisting of methyl alcohol, ethyl alcohol, isopropyl alcohol, n-butyl alcohol, and sec-butyl alcohol;

from about 1 to about 3% of a high boiling solvent having a boiling point of from 120° to about 230° C. selected from the group consisting of ethylene glycol, propylene glycol, trimethylene glycol, tetramethylene glycol, 1,2-butanediol, 1,2-pentanediol, 1,4-pentanediol, 2,3-hexanediol, ethylene glycol monoethyl ether, ethylene glycol monopropyl ether, ethylene glycol monobutyl ether, diethylene glycol monoethyl ether, diethylene glycol monobutyl ether, propylene glycol monopropyl ether, propylene glycol monobutyl ether, and dipropylene glycol monomethyl ether; and water; and a pH modifying agent selected from (i) an acidic pH modifying agent to provide a pH of from about 3.5 to about 6.5 and (ii) a basic pH modifying agent to provide a pH from about 7.5 to about 11.5.

11. A composition according to claim 10, wherein the at least one surfactant consists of at least one anionic surfactant.

12. A composition according to claim 10, wherein the at least one surfactant consists of at least one surfactant selected from the group consisting of sodium dodecyl benzene sulfonate, sodium lauryl sulfate, and nonoxynol-5.

13. A composition according to claim 12, wherein the low boiling solvent is isopropyl alcohol and the high boiling solvent is ethylene glycol monobutyl ether.

14. A composition according to claim 10, wherein the low boiling solvent is isopropyl alcohol and the high boiling solvent is ethylene glycol monobutyl ether.

15. A composition according to claim 10, wherein the fluorosurfactant is selected from the group consisting of FLUORAD FC-129, $R_fSO_2N(C_2H_5)CH_2CO_3^-K^+$, where $R_f$ is $C_nF_{2n+1}$ and n is about 8, and FLUORAD FC-171, $R_fSO_2N(C_2H_5)(CH_2CH_2O)_xCH_3$, where $R_f$ is $C_nF_{2n+1}$, n is about 8, and the average value of x is about 7.

16. A composition according to claim 15, wherein the fluorosurfactant is FLUORAD FC-171, $R_fSO_2N(C_2H_5)(CH_2CH_2O)_xCH_3$, where $R_f$ is $C_nF_{2n+1}$, n is about 8, and the average value of x is about 7.

17. A non-streaking glass cleaning composition formulated for direct application to glass surfaces, in use, the composition consisting essentially of, by percent weight of the entire composition:

from about 0.01 to about 0.5%, in total, of at least one surfactant selected from the group consisting of anionic surfactants, nonionic surfactants, amphoteric surfactants, zwitterionic surfactants, and mixtures thereof;

from about 0.001 to about 0.1% of a fluorosurfactant selected from the group consisting of (a) anionic salts of perfluoroaliphaticoxybenzenesulfonic acids, (b) anionic salts of linear perfluoroalkyloxybenzoic acids, (c) fluorosurfactants having the formula $R_fCH_2CH_2SCH_2CO_2M$, where $R_f$ is $F(CF_2CF_2)_n$, and n is about 3 to about 8 and M is one of an alkali metal and ammonium, (d) fluorosurfactants having the formula $C_nF_{2n+1}CO_2M$, where $C_nF_{2n+1}$ is a straight chain fluorocarbon radical, n is from about 8 to about 12, and M is one of an alkali metal and ammonium, (e) fluorosurfactants having the formula $C_nF_{2n+1}SO_3M$, where $C_nF_{2n+1}$ is a straight chain fluorocarbon radical, n is from about 8 to about 12, and M is an alkali metal cation, (f) fluorosurfactants having the formula $R_fCH_2CH_2O(CH_2CH_2O)_nH$, where $R_f$ is a straight chain $F(CF_2CF_2)_n$ radical and n is from about 3 to about 8, (g) fluorosurfactants having the formula $R_f(OCH_2CH_2)_nOR_f$, where $R_f$ is a branched chain radical selected from the group consisting of $C_8F_{15}$, $C_{10}F_{19}$, and $C_{12}F_{23}$, and n is from about 10 to about 30, (h) fluorosurfactants having the formula $R_f(OCH_2CH_2)_mOR$, where $R_f$ is a branched chain radical selected from the group consisting of $C_9F_{15}$, $C_{10}F_{19}$, and $C_{12}F_{23}$, m is from about 2 to about 20, and R is a $C_1$ to $C_3$ alkyl, (i) FLUORAD FC-129, $R_fSO_2N(C_2H_5)CH_2CO_2^-K^+$, where $R_f$ is $C_nF_{2n+1}$ and n is about 8, and (j) FLUORAD FC-171, $R_fSO_2N(C_2H_5)(CH_2CH_2O)_xCH_3$, where $R_f$ is $C_nF_{2n+1}$, n is about 8, and the average value of x is about 7;

from about 0.1 to about 1% ethylene glycol monohexyl ether;

from about 1 to about 5% of a low-boiling solvent having a boiling point of less than about 115° C. selected from the group consisting of methyl alcohol, ethyl alcohol, isopropyl alcohol, n-butyl alcohol, and sec-butyl alcohol;

from about 1 to about 3% of a high boiling solvent having a boiling point of from 120 to about 230° C. selected from the group consisting of ethylene glycol, propylene glycol, trimethylene glycol, tetramethylene glycol, 1,2-butanediol, 1,2-pentanediol, 1,4-pentanediol, 2,3-hexanediol, ethylene glycol monoethyl ether, ethylene glycol monopropyl ether, ethylene glycol monobutyl ether, diethylene glycol monoethyl ether, diethylene glycol monobutyl ether, propylene glycol monopropyl ether, propylene glycol monobutyl ether, and dipropylene glycol monomethyl ether;

from about 0.01 to about 2% of a pH modifying agent selected from the group consisting of (i) acetic acid, to provide a pH of from about 3.5 to about 6.5, and (ii) aqueous ammonium hydroxide, to provide a pH from about 7.5 to about 11.5; and water.

18. A composition according to claim 17, wherein the at least one surfactant consists of at least one surfactant selected from the group consisting of sodium dodecyl benzene sulfonate, sodium lauryl sulfate, and nonoxynol-5.

19. A composition according to claim 17, wherein the low boiling solvent is isopropyl alcohol and the high boiling solvent is ethylene glycol monobutyl ether.

20. A composition according to claim 17, wherein the fluorosurfactant is selected from the group consisting of FLUORAD FC-129, $R_fSO_2N(C_2H_5)CH_2CO_2^-K^+$, where $R_f$ is $C_nF_{2n+1}$ and n is about 8), and FLUORAD FC-171, $R_fSO_2N(C_2H_5)(CH_2CH_2O)_xCH_3$, where $R_f$ is $C_nF_{2n+1}$, n is about 8, and the average value of x is about 7.

21. A composition according to claim 20, wherein the fluorosurfactant is FLUORAD FC-171, $R_fSO_2N(C_2H_5)(CH_2CH_2O)_xCH_3$, where $R_f$ is $C_nF_{2n+1}$, n is about 8, and the average value of x is about 7.

22. A non-streaking glass cleaning composition formulated for direct application to glass surfaces, in use, the composition consisting essentially of, by percent weight of the entire composition;

from about 0.01 to about 0.5%, in total, of at least one surfactant selected from the group consisting of anionic surfactants, nonionic surfactants, amphoteric surfactants, zwitterionic surfactants, and mixtures thereof;

front about 0.001 to about 0.1% of a fluorosurfactant selected from the group consisting of (a) anionic salts of perfluoroaliphaticoxybenzenesulfonic acids, (b) anionic salts of linear perfluoroalkyloxybenzoic acids, (c) fluorosurfactants having the formula $R_fCH_2CH_2SCH_2CO_2M$, where $R_f$ is $F(CF_2CF_2)_n$, and n is about 3 to about 8 and M is one of an alkali metal and ammonium, (d) fluorosurfactants having the formula $C_nF_{2n+1}CO_2M$, where $C_nF_{2n+1}$ is a straight chain fluorocarbon radical, n is from about 8 to about 12, and M is one of an alkali metal and ammonium, (e) fluorosurfactants having the formula $C_nF_{2n+1}SO_3M$, where $C_nF_{2n+1}$ is a straight chain fluorocarbon radical, n is from about 8 to about 12, and M is an alkali metal cation, (f) fluorosurfactants having the formula $R_fCH_2CH_2O(CH_2CH_2O)_nH$, where $R_f$ is a straight chain $F(CF_2CF_2)_n$ radical and n is from about 3 to about 8, (g) fluorosurfactants having the formula $R_f(OCH_2CH_2)_nOR_f$, where $R_f$ is a branched chain radical selected from the group consisting of $C_8F_{15}$, $C_{10}F_{15}$, and $C_{12}F_{23}$, and n is from about 10 to about 30, (h) fluorosurfactants having the formula $R_f(OCH_2CH_2)_mOR$, where $R_f$ is a branched chain radical selected from the group consisting of $C_0F_{15}$, $C_{10}F_{15}$, and $C_{12}F_{23}$, m is from about 2 to about 20, and R is a $C_1$ to $C_3$, alkyl, (i) FLUORAD FC-129, $R_fSO_2N(C_2H_5)CH_2CO_2^{-K+}$, where $R_f$ is $C_nF_{2n+1}$ and n is about 8, and (j) FLUORAD FC-171, $R_fSO_2N(C_2H_5)(CH_2CH_2O)_xCH_3$, where $R_f$ is $C_nF_{2n+1}$, n is about 8, and the average value of x is about 7;

from about 0.1 to about 1% ethylene glycol monohexyl ether;

from about 1 to about 5% of a low boiling solvent having a boiling point of less than about 115° C. selected from the group consisting of methyl alcohol, ethyl alcohol, isopropyl alcohol, n-butyl alcohol, and sec-butyl alcohol;

from about 1 to about 3% of a high boiling solvent having a boiling point of from 120° to about 230° C. selected from the group consisting of ethylene glycol, propylene glycol, trimethylene glycol, tetramethylene glycol, 1,2-butanediol, 1,2-pentanediol, 1,4-pentanediol, 2,3-hexanediol, ethylene glycol monoethyl ether, ethylene glycol monopropyl ether, ethylene glycol monobutyl ether, diethylene glycol monoethyl ether, diethylene glycol monobutyl ether, propylene glycol monopropyl ether, propylene glycol monobutyl ether, and dipropylene glycol monomethyl ether;

from about 0.01 to about 2% of a pH modifying agent selected from the group consisting of (i) acetic acid, to provide a pH of from about 3.5 to about 6.5, and (ii) aqueous ammonium hydroxide, to provide a pH of from about 7.5 to about 11.5;

from 0 to about 2% of a binder composed of polyacrylic acid resin; and water.

23. A composition according to claim 22, wherein the low boiling solvent is isopropyl alcohol and the high boiling solvent is ethylene glycol monobutyl ether.

24. A composition according to claim 22, wherein the at least one surfactant consists of at least one surfactant selected from the group consisting of sodium dodecyl benzene sulfonate, sodium lauryl sulfate, and nonoxynol-5.

25. A composition according to claim 22, wherein the fluorosurfactant is selected from the group consisting of FLUORAD FC-129, $R_fSO_2N(C_2H_5)CH_2CO_2^-K^+$, where $R_f$ is $C_nF_{2n+1}$ and n is about 8, and FLUORAD FC-171, $R_fSO_2N(C_2H_5)(CH_2CH_2O)_xCH_3$, where $R_f$ is $C_nF_{2n+1}$, n is about 8, and the average value of x is about 7.

26. A composition according to claim 25, wherein the fluorosurfactant is FLUORAD FC-171, $R_fSO_2N(C_2H_5)(CH_2CH_2O)_xCH_3$, where $R_f$ is $C_nF_{2n+1}$, n is about 8, and the average value of x is about 7.

27. A non-streaking glass cleaning composition formulated for direct application to glass surfaces, in use, the composition consisting essentially of, by percent weight of the entire composition:

from about 0.01 to about 0.5% of a surfactant, sodium dodecyl benzene sulfonate;

from about 0.001 to about 0.1% of a fluorosurfactant, FLUORAD FC-171, $R_fSO_2N(C_2H_5)(CH_2CH_2O)_xCH_3$, where $R_f$ is $C_nF_{2n+1}$, n is about 8, and the average value of x is about 7;

from about 0.1 to about 1% of ethylene glycol monohexyl ether;

from about 1 to about 5% of a low boiling solvent, isopropyl alcohol;

from about 1 to about 3% of a high boiling solvent, ethylene glycol monobutyl ether;

a pH modifying agent, aqueous ammonium hydroxide, which is present in the composition in an amount up to about 2%; and water.

* * * * *

UNITED STATES PATENT AND TRADEMARK OFFICE

CERTIFICATE OF CORRECTION

PATENT NO. : 5,750,482
DATED : May 12, 1998
INVENTOR(S) : Gerald Cummings

It is certified that error appears in the above-identified patent and that said Letters Patent is hereby corrected as shown below:

Column 4,
Line 24, please replace "1150°C" with -- 115°C --.

Example 1,
Column 8, in the footnote to the table, after "anionic", add -- flouorosurfactant ($R_fSO_2N$ ($C_2H_5$) $CH_2CH_2O$) x $CH_3$, where Rf is CnF2n+1, n is about 8, and the average value of x is about 7). --

Example 10, the last line of the table, replace "Q.S. 100%" with
-- <<< Q.S 100% >>> --.

Claim 2,
Line 3, replace "($C_3H_5$)" with -- ($C_2H_5$) --.

Claim 10,
Line 31, replace "(h) fluorosuarfactants" with -- (h) Fluorosurfactants --.

Claim 15,
Line 3, replace "CH2CO3" with -- CH2CO2 --.

Claim 17,
Line 33, repalce "C9F15" with -- C8F15, --

Claim 22,
Line 33, replace C0F15, C10F15" t -- C8F15, C10F15" with -- C8F15, c10F19 --.

Signed and Sealed this

Fourth Day of December, 2001

*Attest:*

Nicholas P. Godici

*Attesting Officer*

NICHOLAS P. GODICI
*Acting Director of the United States Patent and Trademark Office*